US010066826B2

(12) United States Patent
Jiang

(10) Patent No.: US 10,066,826 B2
(45) Date of Patent: Sep. 4, 2018

(54) LED LIGHT BULB

(71) Applicant: JIAXING SUPER LIGHTING ELECTRIC APPLIANCE CO., LTD., Jiaxing Zhejiang (CN)

(72) Inventor: Tao Jiang, Jiaxing (CN)

(73) Assignee: JIAXING SUPER LIGHTING ELECTRIC APPLIANCE CO., LTD, Jiaxing (CN)

( * ) Notice: Subject to any disclaimer, the term of this patent is extended or adjusted under 35 U.S.C. 154(b) by 54 days.

(21) Appl. No.: 15/014,523

(22) Filed: Feb. 3, 2016

(65) Prior Publication Data

US 2016/0223182 A1 Aug. 4, 2016

Related U.S. Application Data

(63) Continuation of application No. 15/011,550, filed on Jan. 30, 2016.

(30) Foreign Application Priority Data

Feb. 4, 2015 (CN) ..... 2015 1 0058062
Apr. 17, 2015 (CN) ..... 2015 1 0185283

(51) Int. Cl.

| | |
|---|---|
| ***F21V 29/83*** | (2015.01) |
| ***F21K 9/232*** | (2016.01) |
| ***F21V 29/506*** | (2015.01) |
| ***F21V 29/77*** | (2015.01) |
| ***F21V 23/00*** | (2015.01) |
| *F21V 29/503* | (2015.01) |
| *F21V 3/00* | (2015.01) |
| *F21Y 115/10* | (2016.01) |
| *F21Y 107/40* | (2016.01) |

(52) U.S. Cl.

CPC ..... *F21V 29/83* (2015.01); *F21K 9/232* (2016.08); *F21V 23/009* (2013.01); *F21V 29/506* (2015.01); *F21V 29/77* (2015.01); *F21V 3/00* (2013.01); *F21V 29/503* (2015.01); *F21Y 2107/40* (2016.08); *F21Y 2115/10* (2016.08)

(58) Field of Classification Search

CPC ..... F21V 29/02; F21V 29/60; F21V 29/83; F21V 29/70; F21V 29/77

See application file for complete search history.

(56) References Cited

U.S. PATENT DOCUMENTS 8,525,395 B2 * 9/2013 Muessli ..... F21V 29/004 313/46
8,616,714 B2 * 12/2013 Lee ..... F21V 29/713 313/46
2009/0059559 A1 * 3/2009 Pabst ..... F21V 29/2212 362/84

(Continued)

FOREIGN PATENT DOCUMENTS

WO WO 2013082223 A1 * 6/2013 ..... F21V 3/02

*Primary Examiner* — Julie Bannan

(74) *Attorney, Agent, or Firm* — Im IP Law; C. Andrew Im

(57) ABSTRACT

The LED light bulb comprises an outer case, a heatsink, an LED light module, a power driver and a metallic bulb base. The LED light module includes a circuit board and an LED light source. The outer case includes a plurality of vent apertures. An interior surface of the heatsink defines a heatsinking pathway. The heatsinking pathway and the vent apertures are disposed and configured to provide a convection airflow pathway.

13 Claims, 18 Drawing Sheets

(56) References Cited

U.S. PATENT DOCUMENTS

| | | | | |
|---|---|---|---|---|
| 2009/0237932 | A1* | 9/2009 | Lee | F21K 9/23 362/249.02 |
| 2010/0073944 | A1* | 3/2010 | Chen | F21V 3/02 362/373 |
| 2012/0049732 | A1* | 3/2012 | Chuang | F21V 29/83 315/32 |
| 2012/0268936 | A1* | 10/2012 | Pickard | F21K 9/90 362/249.02 |
| 2012/0300455 | A1* | 11/2012 | Breidenassel | F21V 3/02 362/235 |
| 2013/0016508 | A1* | 1/2013 | Progl | F21V 3/02 362/235 |
| 2013/0328474 | A1* | 12/2013 | Wheelock | F21V 3/00 313/36 |
| 2014/0340899 | A1* | 11/2014 | Bailey | F21V 23/006 362/245 |
| 2016/0123571 | A1* | 5/2016 | Chan | F21V 29/83 362/249.01 |

* cited by examiner

LED LIGHT BULB

RELATED APPLICATIONS

The present application is a continuation of U.S. application Ser. No. 15/011,550 filed Jan. 30, 2016, which claims the benefit of the Chinese Applications CN201510185283.6 filed Apr. 17, 2015 and CN201510058062.2 filed Feb. 4, 2015, each of which is incorporated herein by reference in its entirety.

FIELD OF THE INVENTION

The claimed invention relates to an LED light bulb.

BACKGROUND OF THE INVENTION

LED-based lamps—popular for their service life, compactness and energy efficiency—have become an acclaimed substitute for incandescent lamps, but not without potential drawbacks. LED light sources, when working, generate profuse heat; the hotter they get, the worse they function and the sooner they break down. Thus, thermal management has been a huge concern of manufacturers of LED luminaries. Heat, when trapped and accumulated inside the relatively small space of an LED light bulb, causes lumen depreciation or even premature failure. To overcome overheating problems suffered by LED light bulbs, a common solution is to provide a heatsink made of an enlarged metallic object with decent thermal conductivity. The heatsink, which is disposed outside the case of the LED light bulb and thus in direct contact with ambient air, brings heat—which is first conductively transferred to the surface of the heatsink—away from the light bulb with the help of radiation and convection. However, the structure is criticized for its potential safety issues and costs. The risk of electric shock gets greater because the metallic object, which is not only thermally but also electrically conductive, is directly exposed to human touch. Moreover, an insulated power supply must be provided—driving up costs due to a stringent demand for safety and consistency of the power supply—because otherwise the presence of a metallic object will prevent the LED light bulb from completing a high voltage test.

Another solution is to cover an aluminum-based heatsink with a plastic layer presumably to prevent electric shock. However, the plastic coating prevents heat in the aluminum alloy from going out because of poor thermal conductivity of plastic materials. Plastic covering, despite its safety bonus, is unacceptable for LED lamps with higher luminous output and more heat that must be effectively steered away.

Yet another solution is to electrically insulate the outer case of a light bulb while enlarging the LED circuit board, which is configured to serve as a conduit both for power and heat. An example is disclosed in an article published on "China LED online" (a blog hosted by Wechat™, which is a mobile-based messaging service widely used in China). The article discloses an LED light bulb, as shown in FIGS. 1 and 2, which comprises an outer case and two circuit boards. The outer case is made of insulating plastic material and includes vent apertures on the top and the bottom of the case. The two circuit boards—larger than usual—are disposed axially inside the outer case and intersect each other perpendicularly. A power driver, electrically insulated by the outer case, is integrally provided on the lower portion of a first circuit board. Heat generated by LED packages is conducted to the circuit boards and then taken away through a convective pathway defined by the outer case and the circuit boards. LED packages—mounted on the circuit boards, which are disposed upright along a longitudinal axis inside the outer case—are thus configured to direct their luminous outputs across a wide angle around the entire bulb. In this design, the role otherwise played by a metallic heatsink in some light bulbs now has to be accommodated by the circuit boards, which do not always do a good job transmitting heat. To cope with the overheating issue, enlarged circuit boards must be provided, which drive cost up. When an oversized circuit board gets very close to or even in contact with the inner surface of the outer case, light beaming from LED packages cannot be well diffused—thus discrete dim spots are observed—to visually resemble incandescent lamps. Moreover, the light bulb does not emit as much luminous output as it should because a significant amount of light is first directed back to the circuit boards, which then reflect the light to the inner surface of the outer case as opposed to going directly, and more productively, to the outer case. Furthermore, when almost the entire space inside the outer case constitutes what is called convective pathway, the convective activity in the light bulb is not as effective as when a more structurally defined pathway is provided. Finally, larger vent apertures must be provided to accommodate the absence of a metallic heatsink and poor thermal conductivity of the circuit boards. In one embodiment, the cross-sectional area of the top aperture is as big as 634 square millimeters and that of the bottom aperture 1500 square millimeters. The apertures—all with a sizable opening—heighten the threat of electric shock because electricity-loaded parts inside the light bulb are inadvertently accessible.

OBJECTS AND SUMMARY OF THE INVENTION

Therefore, it is an object of the claimed invention to provide a significantly improved LED light bulb that dissipates heat more efficiently and that is safer. It is a further object of the claimed invention to provide an LED light bulb which solves aforementioned problems with the LED light bulbs.

In accordance with an exemplary embodiment of the claimed invention, the LED light bulb comprises an outer case, a heatsink, an LED light module, a power driver and a metallic bulb base. The LED light module includes a circuit board and an LED light source. The LED light module is thermally coupled to an exterior surface of the heatsink. The heatsink is disposed inside the outer case and is mounted on an upper end of the metallic bulb base. The outer case includes a plurality of vent apertures. An interior surface of the heatsink defines a heatsinking pathway. The heatsinking pathway and the vent apertures are disposed and configured to provide a convection airflow pathway.

In accordance with an exemplary embodiment of the claimed invention, the aforesaid vent apertures include an upper aperture. Heat generated by the LED light source is convectively transferred along the heatsinking pathway and egresses the light bulb through the upper aperture. Preferably, the vent apertures furthers include a lower aperture. Ambient air enters the light bulb through the lower aperture, than moves upwards along the heatsinking pathway, and finally egresses the light bulb through the upper aperture.

In accordance with an exemplary embodiment of the claimed invention, the lower aperture has a greater cross-sectional area than the upper aperture. The upper aperture has a cross-sectional area in the range of 100 square millimeters to 500 square millimeters. The lower aperture has a cross-sectional area in the range of 200 square millimeters to 1200 square millimeters.

In accordance with an exemplary embodiment of the claimed invention, the aforesaid heatsink is tubular and includes an exterior surface and an interior surface. The LED light module is thermally coupled to the exterior surface of the heatsink. The interior surface of the heatsink defines a heatsinking pathway.

In accordance with an exemplary embodiment of the claimed invention, the outer case of the aforesaid LED light bulb comprises a top exhaust channel which extends inwardly from the dome of the outer case. An upper opening of the top exhaust channel encompasses the upper apertures and is configured to guide airflow out of the outer case through the upper apertures. An airflow convection pathway is defined by, sequentially from the bottom up: the lower apertures, the heatsinking pathway, the top exhaust channel and the upper vent apertures. Ambient air enters the light bulb through the lower apertures. The airflow is loaded up with heat while traveling through the heatsinking pathway. Thermally loaded air then goes up through the top exhaust channel and eventually egresses the light bulb through the upper vent apertures. The airflow convection pathway bolsters the stack effect in the light bulb due to a greater thermal difference along the pathway as well as the axial length of the structure. A stronger ventilation results in the benefit of better heat dissipation.

In accordance with an exemplary embodiment of the claimed invention, the lower end of the heatsinking pathway has a greater cross-sectional area than the upper end thereof. The lower portion of the heatsink includes an exterior surface in the shape of a cylinder. The upper portion of the heatsink includes an exterior surface in the shape of a pyramidal frustum. The ratio of the length of the upper portion of the heatsink in the axial direction to that of the lower portion of the heatsink is in the range of 1:1 to 5:1, or preferably, 1.5:1 to 2.5:1. The cross section of the upper portion of the heatsink is a polygon. Preferably, the cross section is a triangle, a quadrilateral, a pentagon or a hexagon. In other words, the upper portion of the heatsink is a triangular frustum, a quadrilateral frustum, a pentagonal frustum or a hexagonal frustum. In an alternative embodiment, the upper portion of the heatsink is a conic frustum. To adapt to the lateral surface of a truncated cone, an LED light module made of a pliable or bendable material is thermally coupled to the exterior surface of the upper portion of the heatsink. The LED light module is thermally coupled to the exterior surface of the upper portion of the heatsink. The exterior surface of the upper portion of the heatsink includes a plurality of lateral faces. An angle in the range of 0 to 90 degrees is defined by the lateral face and the perpendicular axis of the heatsink. Preferably, the angle is the range of 10 to 30 degrees, or most preferably, 15 degree. When the angle is greater than 0 and but less than 90 degrees, a portion of the rays from the LED light sources are directed vertically. Also, the rays beaming from the respective LED light modules coupled to each of the lateral faces of the upper portion of the heatsink are directed omnidirectionally throughout the light bulb. The luminous output of the LED light sources is thus configured to be evenly distributed all around the light bulb such that an observer will not perceive discrete transitions between brighter spots and shadows. Thus, the LED light bulb lives up to if not exceeds our expectation for three-dimensional illumination even when a reflector cup or a refraction lens is not deployed. When the angle is exactly 0, the rays are directed at a right angle in relation to the axis of the heatsink. Even distribution of luminous output is likewise achieved for reasons articulated above where the angle is greater than 0 and less than 90 degrees. When the angle is exactly 90 degrees, all of the rays are directed upwards so even illumination is unlikely if the light bulb is provided as is. Optionally, a reflector cup—two embodiments are described—is provided to re-direct part of the rays to the lateral sides of the light bulb to produce an evenly-distributed luminous output.

In accordance with an exemplary embodiment of the claimed invention, the power driver is disposed inside the light bulb in the lower end of the outer case and is electrically connected to the metallic bulb base through an input wire. An output wire electrically connects the power driver and the LED light module. Electric current flows sequentially to the metallic bulb base, the input wire and the power driver, which regulates the incoming electric current. Regulated current then flows through the output wire to light up the LED light source on the LED light module.

In accordance with an exemplary embodiment of the claimed invention, the outer case includes a pair of half pieces which are symmetrical with respect to a longitudinal axis. The outer case is formed by joining the pair of half pieces together. The outer case is primarily made of plastic materials.

In accordance with an exemplary embodiment of the claimed invention, the heatsink is disposed inside the outer case. The exterior surface of the upper portion of the heatsink and the interior surface of the outer case are spaced apart. Preferably, the space is in the range of 5 to 30 millimeters, and most preferably, 18 to 22 millimeters. The LED light module is thermally coupled to the exterior surface of the upper portion of the heatsink, i.e. the lateral face of the pyramidal frustum. Advantageously, the LED light bulb prevents dim spots from appearing when lit up so it generates a visually even luminous effect similar to incandescent lamps. Unlike some other designs where the light is first directed towards the heatsink, which then imperfectly reflects the light back to the interior surface of the outer case, the rays from the LED light source are made to go directly to the interior surface of the outer case to mitigate luminous loss.

In accordance with an exemplary embodiment of the claimed invention, the heatsink includes a plurality of fins to boost heat dissipation. The plurality of fins include a number of fins in the range of 2 to 50. Preferably, the number is in the range of 3 to 30, and most preferably, 6 to 20. In one embodiment, the lateral faces of the fin are configured to extend inside heatsink in a direction substantially parallel to the axis of the heatsink so as not to block airflow along the heatsinking pathway. Heat generated by the LED light module, which is thermally coupled to the exterior surface of the heatsink, is first conducted to the exterior surface of the heatsink, from which the heat is then removed primarily through convection. The plurality of the fins disposed inside the heatsink facilitate internal convection because they add to the overall surface of the heatsink in contact with the airflow.

Thus, in accordance with an exemplary embodiment of the claimed invention, the LED light bulb comprises an outer case, a heatsink, an LED light module, a power driver and a metallic bulb base. The LED light module is thermally coupled to an exterior surface of the heatsink. The heatsink is disposed inside the outer case and is mounted on an upper end of the metallic bulb base. The outer case includes a plurality of vent apertures. A fin extends from an interior surface of the heatsink inwardly towards a central space of the heatsink. The interior surface of the heatsink and an exterior surface of the fin define a heatsinking pathway. The heatsinking pathway and the vent apertures are disposed and configured to provide a convective airflow pathway.

The heatsink of the aforementioned LED light bulb defines a central axis passing therethrough. In one embodiment, the distance from a tip of the fin to at least one point on the central axis is zero. In another embodiment, the distance from a tip of the fin to at least one point on the central axis is greater than zero.

The heatsink of the aforementioned LED light bulb defines a central axis passing therethrough. The central axis intersects a plane to which the central axis is a normal line at an intersection point in the heatsinking pathway. In one embodiment, the distance along the plane from a tip of the fin to the intersection point is greater than zero.

In accordance with an exemplary embodiment of the claimed invention, the aforementioned heatsink includes a plurality of fins. The distances along the plane from each of the tips of the fins to the intersection point are identical. In another embodiment, the distance along the plane from the tip of a first fin to the intersection point is different from that of a second fin. In yet another embodiment, none of the distances along the plane from each of the tips of the fins to the intersection point are identical to that of another fin.

In accordance with an exemplary embodiment of the claimed invention, the distances along the plane from each of the tips of the fins to the intersection point are in the range of 2 to 12 millimeters.

In accordance with an exemplary embodiment of the claimed invention, the depth of the fin along the radial direction of the LED light bulb is in the range of 0.5 to 1.5 millimeters. Preferably, the length of the fin along the axial direction of the LED light bulb is in the range of 1 to 10 millimeters, and most preferably, 3 to 7 millimeters.

The LED light bulb of the claimed invention is configured to define an airflow convection pathway that enhances ventilation like a chimney inside the light bulb. The components of the LED light bulb are not limited to any particular material, shape or dimension. The outer case, the heatsink, the LED light module, the power driver and the metallic bulb base are made of materials known by a person having ordinary skill in the art.

Preferably, the outer case is made of plastic materials. The entire outer case is transparent or diffusive. Alternative, the upper portion of the outer case is transparent and the lower portion thereof is diffusive. The outer case made of plastic materials—an insulator—shields humans from the danger of inadvertently contacting the electricity-loaded parts inside the light bulb.

In accordance with an exemplary embodiment of the claimed invention, the heatsink is made of metal, thermal conductive polymer or thermal conductive ceramic. When the heatsink is made of metal—which is conducive to thermal conduction but weak on thermal radiation, a coating is applied to the surface of the heatsink to boost radiation. For example, a layer of aluminium oxide is coated on the interior surfaces of the heatsink, the fins or both. In one embodiment, a layer of graphene is plated on the LED light module and the exterior surface of the heatsink to facilitate heat dissipation of the LED light module. In another embodiment, the heatsink is made of aluminum. The surface of the heatsink is coated with a layer of aluminium oxide.

An airflow convection pathway, which boosts ventilation like a chimney, is defined inside the LED light bulb of the claimed invention to boost heat dissipation. In particular, the conduits for light and heat are kept separate inside the LED light bulb. Heat is transferred along the heatsinking pathway inside the heatsink, which is configured to maximize the stack effect. The LED light module, which is thermally coupled top the exterior surface of the heatsink, illuminates outside the heatsink. Thus, illumination and heat dissipation have their respective specialized spaces in the light bulb, enabling the LED light bulb to produce an even luminous output, to minimize lumen loss and to significantly improve heat dissipation.

Various other objects, advantages and features of the present invention will become readily apparent from the ensuing detailed description, and the novel features will be particularly pointed out in the appended claims.

BRIEF DESCRIPTION OF FIGURES

The following detailed descriptions, given by way of example, and not intended to limit the present invention solely thereto, will be best be understood in conjunction with the accompanying figures.

DETAILED DESCRIPTION OF THE EMBODIMENTS

Figure 3:
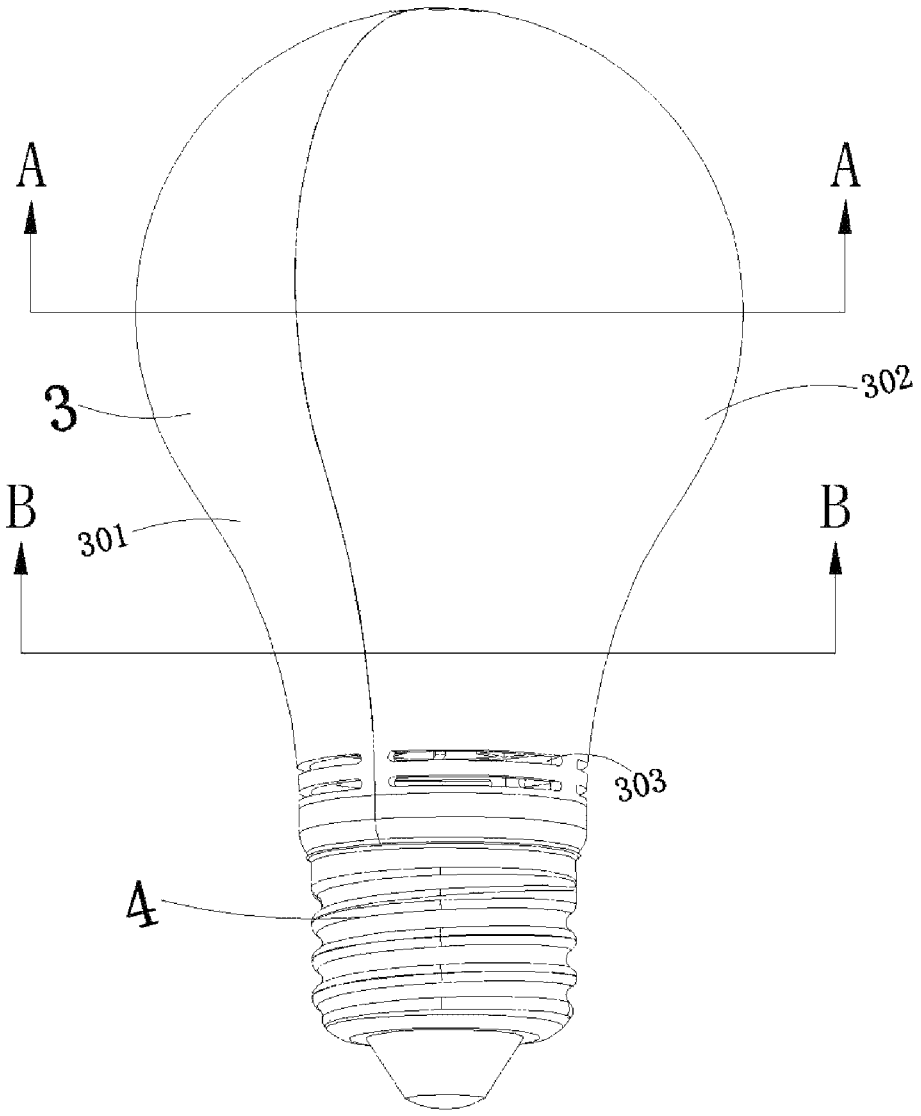
FIG. 3 is a frontal view of an LED light bulb in accordance with an exemplary embodiment of the claimed invention.
Figure 4:
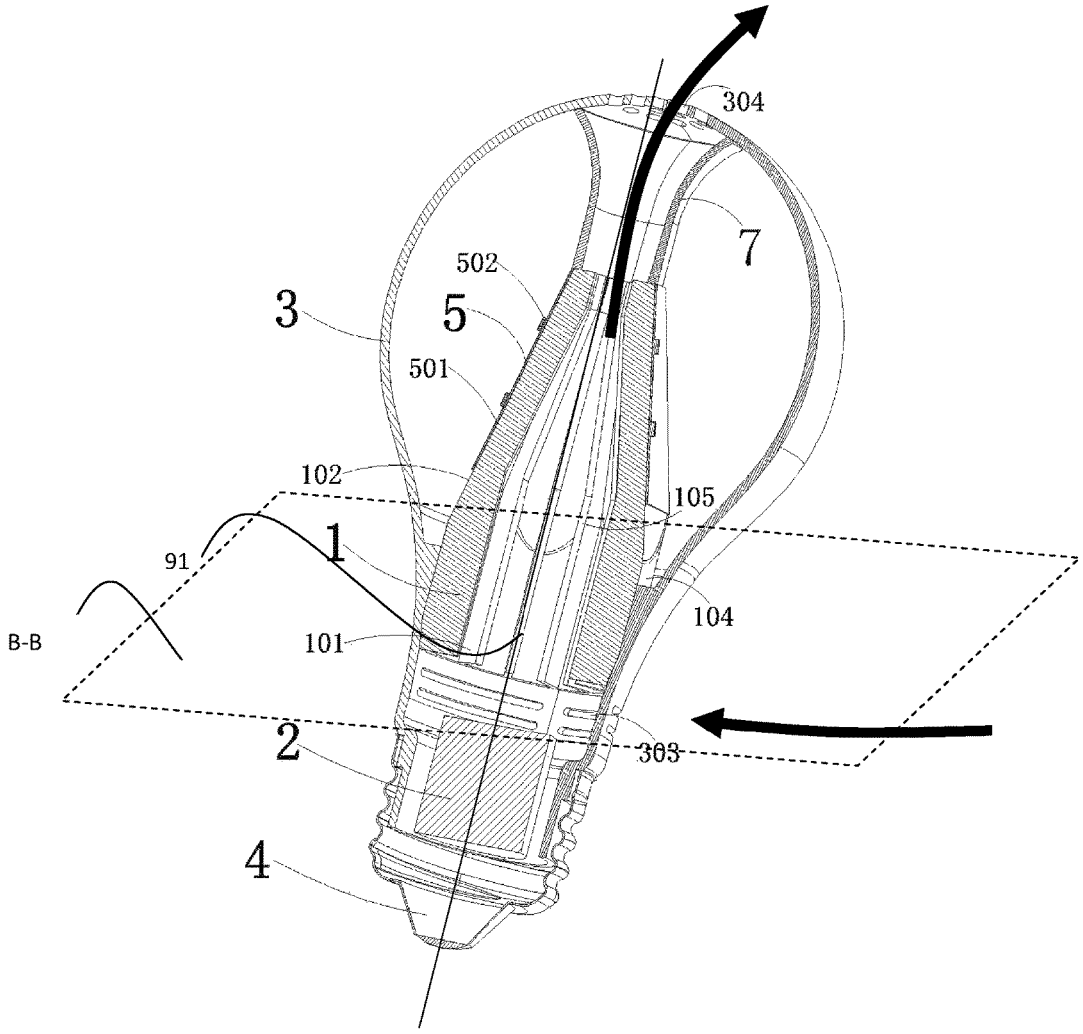
FIG. 4 is a cross-sectional view of an LED light bulb in accordance with an exemplary embodiment of the claimed invention.
Figure 5:
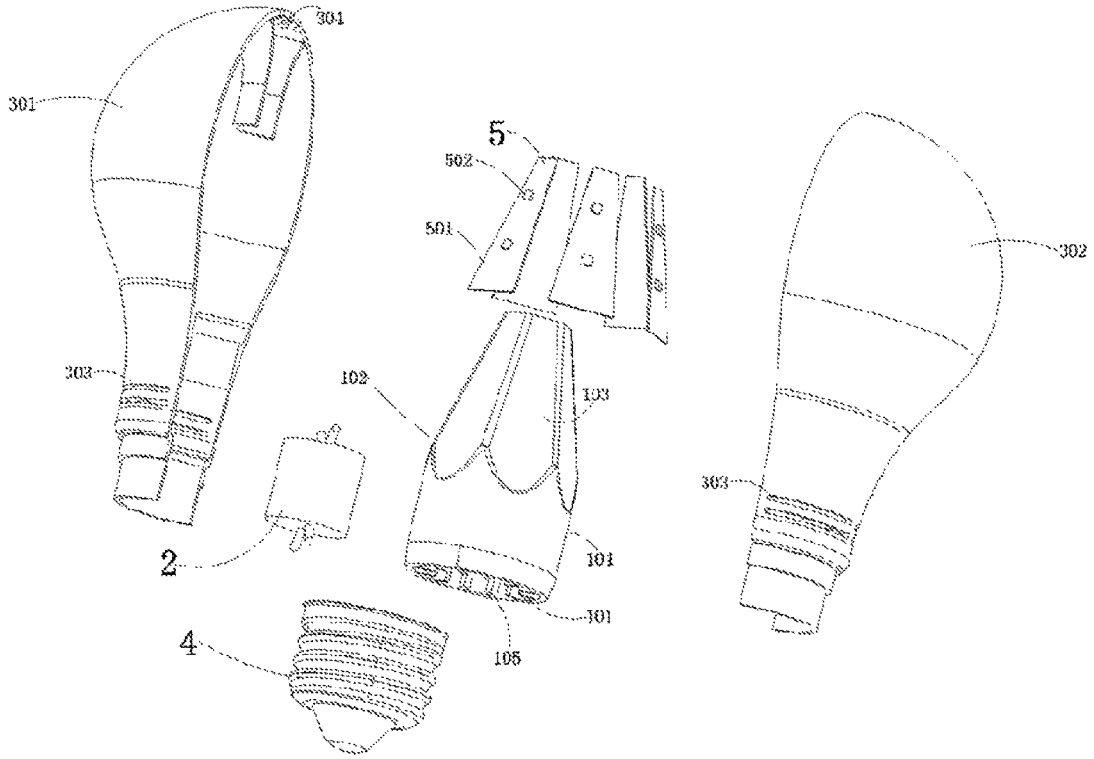
FIG. 5 is an exploded view of an LED light bulb in accordance with an exemplary embodiment of the claimed invention.

Referring to FIGS. 3 to 5, in accordance with an exemplary embodiment of the claimed invention, the LED light bulb comprises a heatsink 1, a power driver 2, an outer case 3, a metallic bulb base 4 and a plurality of LED light modules 5. The heatsink 1 is disposed inside the outer case 3 and is mounted on an upper end of the metallic bulb base 4. The heatsink 1 includes an interior surface 101 and an exterior surface 102. The interior surface 101 of the heatsink defines a heatsinking pathway. The outer case 3 includes a first half piece 301 and a second half piece 302. The outer case 3 is formed by joining the two half pieces 301, 302 together. The outer cases 3 includes a lower vent aperture 303 and an upper vent aperture 304. The LED light module 5 includes a circuit board 501 and an LED light source 502 and is thermally coupled to the exterior surface 102 of the heatsink. The power driver 2 is disposed in a lower portion of the outer case 3 and is electrically connected to the metallic bulb base 4 through an input wire. An output wire electrically connects the power driver 2 and the LED light module 5. Starting from the power driver 2, the output wire extends over a space defined by the interior surface 101 of the heatsink. Then the wire reaches the LED light module 5 through an opening defined by a cross section at a topmost end of the heatsink 1. Alternatively, through apertures are provided on the LED light module 5 and the heatsink 1. The wire passes through the through apertures to electrically connect the LED light module 5. Electric current flows sequentially to the metallic bulb base 4, the input wire and the power driver 2, which regulates the incoming electric current. Regulated current then flows through the output wire to light up the LED light source 502 on the LED light module 5.

In accordance with an exemplary embodiment of the claimed invention, a convection airflow pathway is provided inside the LED light bulb. The convection airflow pathway is defined by the lower vent aperture 303, the heatsinking pathway defined by the interior surface 101 of the heatsink, a top exhaust channel 7 inside the outer case 3 and the upper vent aperture 304. Turning to FIG. 4 as shown by the arrows, ambient air enters through the lower vent aperture 303, then passes through the heatsinking pathway and exits the light bulb from the upper vent aperture 304. A lower portion 104 of the heatsink 1 is a cylinder. An upper portion 103 of the heatsink 1 is a pyramidal frustum. For example, the upper portion 103 of the heatsink 1 of the LED light bulb described in FIGS. 4 and 5 is a pentagonal frustum. In other words, a cross section of the upper portion 103 of the heatsink 1 is a pentagon. In one embodiment, the ratio of the length of the upper portion 103 of the heatsink 1 in the axial direction to that of the lower portion 104 is in the range of 1:1 to 5:1. In a preferred embodiment, the ratio is in the range of 1.5:1 to 2.5:1. For example, in the LED light bulb described in FIGS. 4 and 5, the ratio of the length of the upper portion 103 of the heatsink 1 in the axial direction to that of the lower portion 104 is 2:1. In one embodiment, the lower section of the heatsinking pathway inside the heatsink 1 is a tubular channel having a uniform radius. However, the upper section of the heatsinking pathway inside the heatsink 1 is a cone-shaped channel that tapers from the bottom to the top. The cone-shaped pathway reinforces the stack effect and facilitates air movement in the heatsink 1. In another embodiment, the heatsinking pathway inside the heatsink 1 is cylindrical both in the upper section and the lower section with a same radius. In this embodiment, the shape of the heatsinking pathway inside the heatsink 1 differs from that of the exterior surface of the heatsink 1. For example, the heatsink 1 includes a wall having an upper portion and a lower portion. The upper portion is thicker than the lower portion.

In accordance with an exemplary embodiment of the claimed invention, the top exhaust channel 7 is made of an optically transmissive material, e.g. polycarbonates, to allow passage of light beaming upwards from the LED light source. Preferably, the top exhaust channel 7 is made of a same material as the bulb shell. The top exhaust channel 7 and the heatsink 1 are fixedly coupled to each other and fit together at a joint. The top exhaust channel 7 and the heatsink 1 are either glued together, interlocked together or fastened together. The caliber of the joint is either greater than, less than or equal to that of the heatsinking pathway. For example, the joint fits into the top exhaust channel 7 when the joint is bigger than the heatsinking pathway, or alternatively, into the heatsinking pathway when the joint is smaller than the heatsinking pathway. The joint is configured to hold the top exhaust channel 7 and the heatsink 1 together and to enable ambient air coming in the light bulb through the lower aperture 303 to flow along the heatsink pathway, then through the top exhaust channel 7 and eventually go out of the bulb through the upper vent aperture 304.

Figure 7:
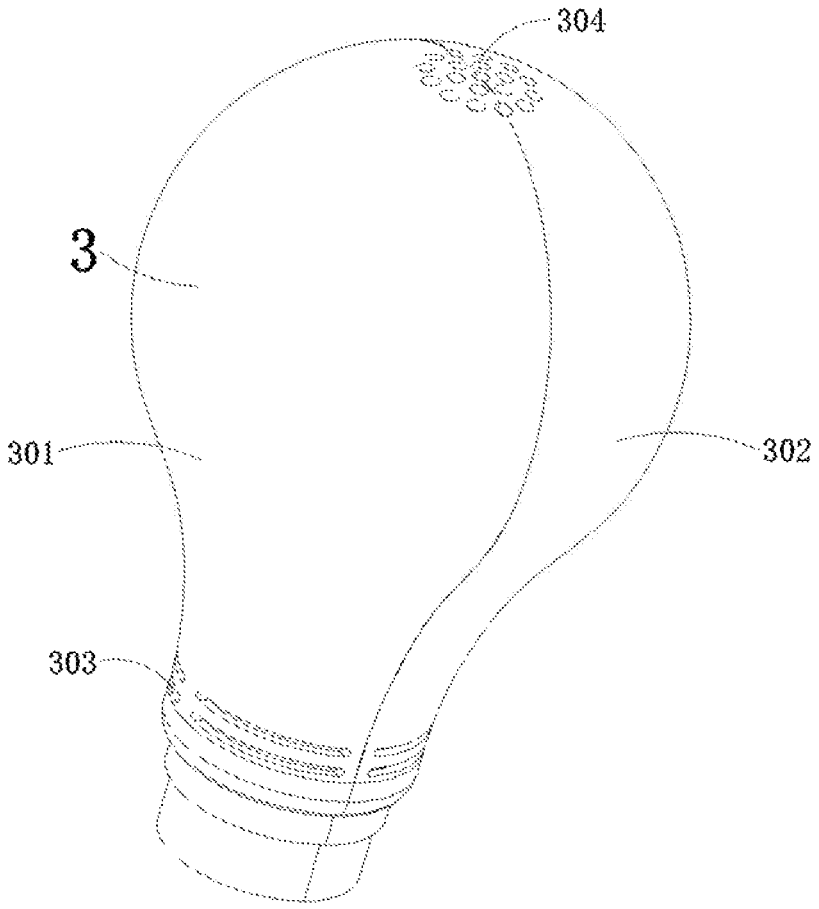
FIG. 7 is a perspective view of the outer case of an LED light bulb in accordance with an exemplary embodiment of the claimed invention.

Turning to FIG. 7, in accordance with an exemplary embodiment of the claimed invention, the upper vent aperture 304 on the outer shell 3 has a cross-sectional area in the rage of 100 to 500 square millimeters, preferably 150 to 400 square millimeters. The lower vent aperture 303 on the outer shell 3 has a cross-sectional area in the rage of 200 to 1200 square millimeters, preferably 450 to 1000 square millimeters. Contrasted with the LED light bulb disclosed in the prior art, as show in FIGS. 1 and 2, the LED light bulb in this embodiment has smaller vent apertures to minimize the risk of inadvertent contact with electricity-loaded parts inside the light bulb by humans.

Returning to FIG. 4, in accordance with an exemplary embodiment of the claimed invention, the heatsink 1 is made of metal or plastic material having high thermal conductivity. Preferably, a plurality of fins 105 are disposed on the interior surface 101 of the heatsink. The LED light module 5 is thermally coupled or adhered to the exterior surface 102 of the heatsink. Heat generated by the LED light source 502 is conductively transferred to the heatsink 1 and then taken away from the heatsink 1 primarily through internal convection. The fins 105 on the interior surface 101 of the heatsink increase the overall surface of the heatsink 1 in contact with the airflow and thus facilitate convective and radiative removal of heat from the light bulb.

Figure 6:
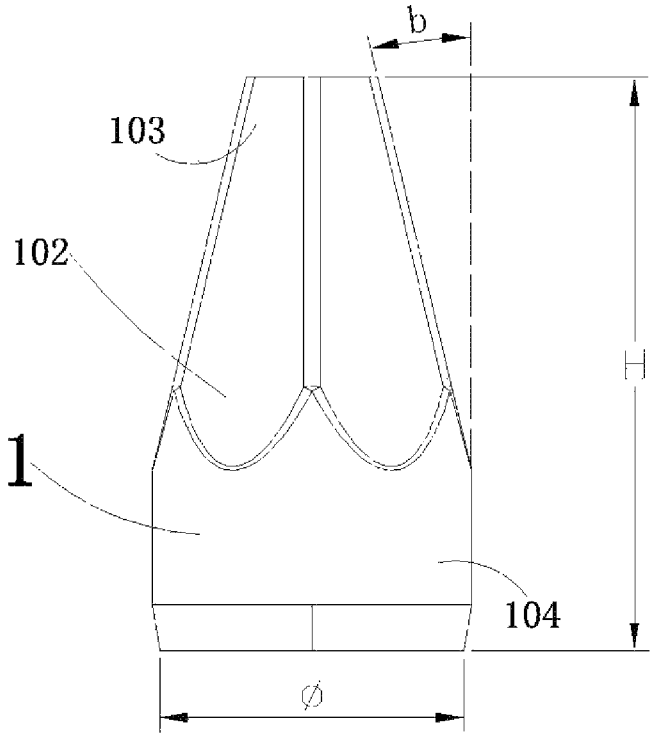
FIG. 6 is a perspective view of the heatsink in an LED light bulb in accordance with an exemplary embodiment of the claimed invention.

Turning to FIGS. 4 to 6, the LED light module 5 is thermally coupled to the exterior surface of the upper portion 103 of the heatsink 1. The exterior surface of the upper portion 103 of the heatsink 1 includes a plurality of lateral faces. The lateral face is situated at an angle in relation to the perpendicular axis of the heatsink 1. A cross section of the exterior surface of the upper portion 103 defines a regular polygon circumscribed by a circle centered on a point on the perpendicular axis of the heatsink 1. In other words, the upper portion 103 of the heatsink 1 defines a pyramidal frustum. Preferably, the lower portion 104 of the heatsink 1 is a cylinder standing on a base of the cylinder. The exterior surface of the upper portion 103 of the heatsink 1 and the exterior surface of the lower portion 104 the heatsink 1 define an angle b. Angle b is in the range of 0 to 90 degrees, preferably 10 to 30 degrees, or most preferably, 15 degrees. When angle b is 0, the LED light source 503 sheds its rays at a right angle in relation to the perpendicular axis. When angle b goes up from 0, more of the rays from the LED light source 502 are directed upwards in the light bulb. The rays are evenly shed across the light bulb when angle b is less than 90 degrees.

Figure 10:
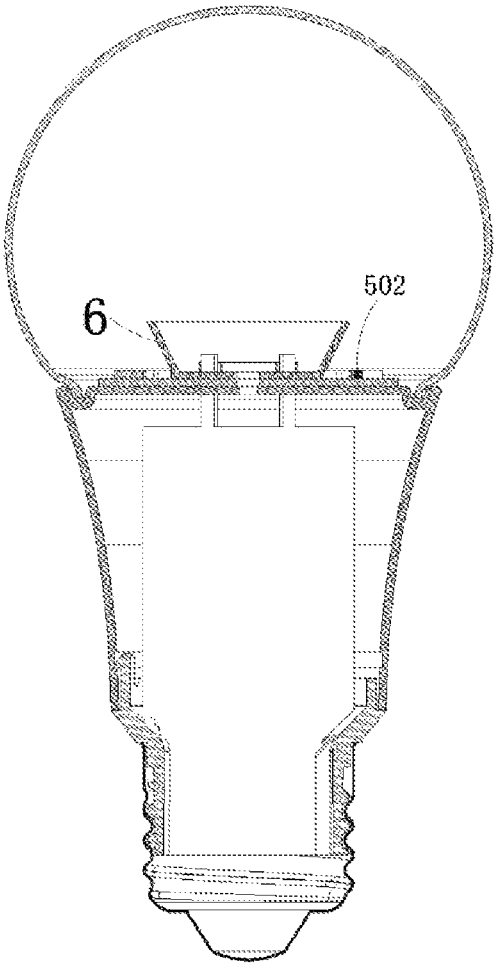
FIG. 10 is a cross-sectional view of a first LED light bulb in accordance with an exemplary embodiment of the claimed invention where the angle b in the heatsink shown in FIG. 6 is 90 degrees.
Figure 11:
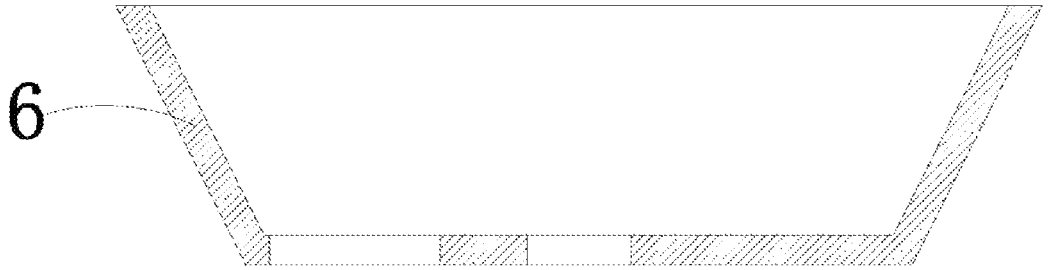
FIG. 11 is a frontal view of the reflector cup in the LED light bulb in FIG. 10.
Figure 12:
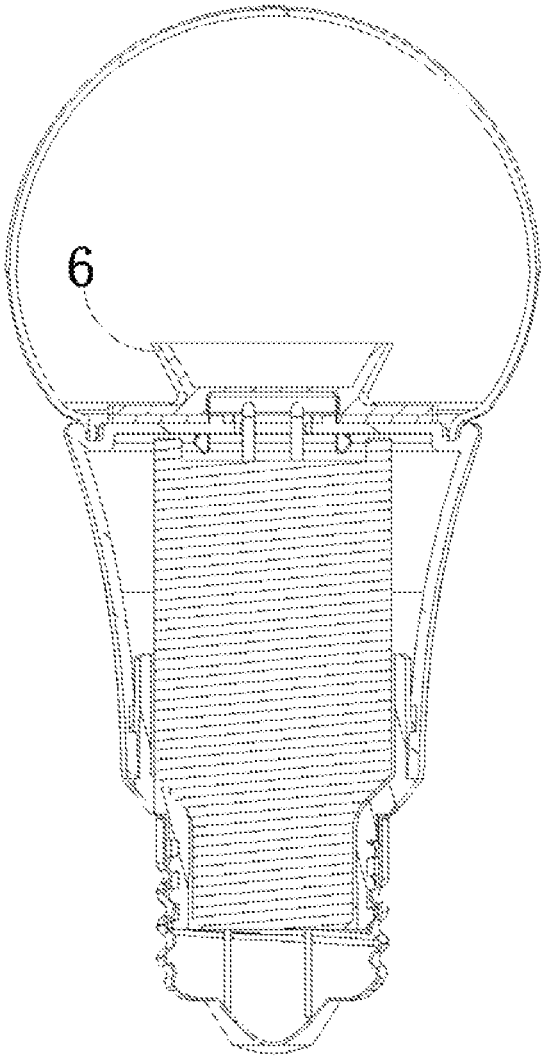
FIG. 12 is a cross-sectional view of a second LED light bulb in accordance with an exemplary embodiment of the claimed invention where the angle b in the heatsink shown in FIG. 6 is 90°.
Figure 13:
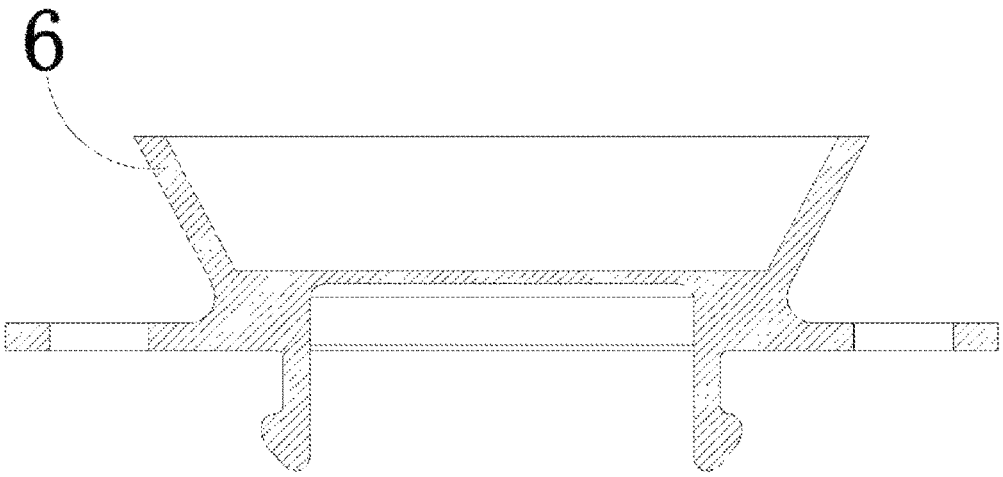
FIG. 13 is a frontal view of the reflector cup in the LED light bulb in FIG. 12.

When angle b is 90°, all of the rays from the LED light source 502 are directed upwards. In accordance with an exemplary embodiment of the claimed invention, a reflector cup is provided to evenly distribute the luminous output across the light bulb. Turning to FIGS. 10 and 11, the reflector cup 6 is bolted to or otherwise mounted on an upper end of the heatsink 1. The lateral faces of the reflector cup 6 are optically reflective. The reflector cup 6 directs part of the rays from the LED light source 502 downwards to the lateral surface of the light bulb such that the overall luminous effect covers a sector over 180 degrees. Turning now to FIGS. 12 and 13, the reflector cup 6 further comprises a flange around the bottom portion to prevent electric shock. A plurality of apertures are provided on the flange. The apertures are substantially the same as or slightly bigger than the LED light source 502 dimensionally in terms of radius and depth to allow the LED light source 502 to be seen through the apertures. The reflector cup 5 is mechanically coupled to the heatsink 1. In one embodiment, the reflector cup 6 and the heatsink 1 are coupled together with a snap buckle. The snap buckle comprises an arm on the bottom of the reflector cup 6 and a cavity on the upper end of the heatsink 1. The reflector cup 6 and the heatsink 1 are coupled together when the arm passes through an aperture on the LED light module 501 and engages with the cavity in the heatsink 1.

Figure 8:
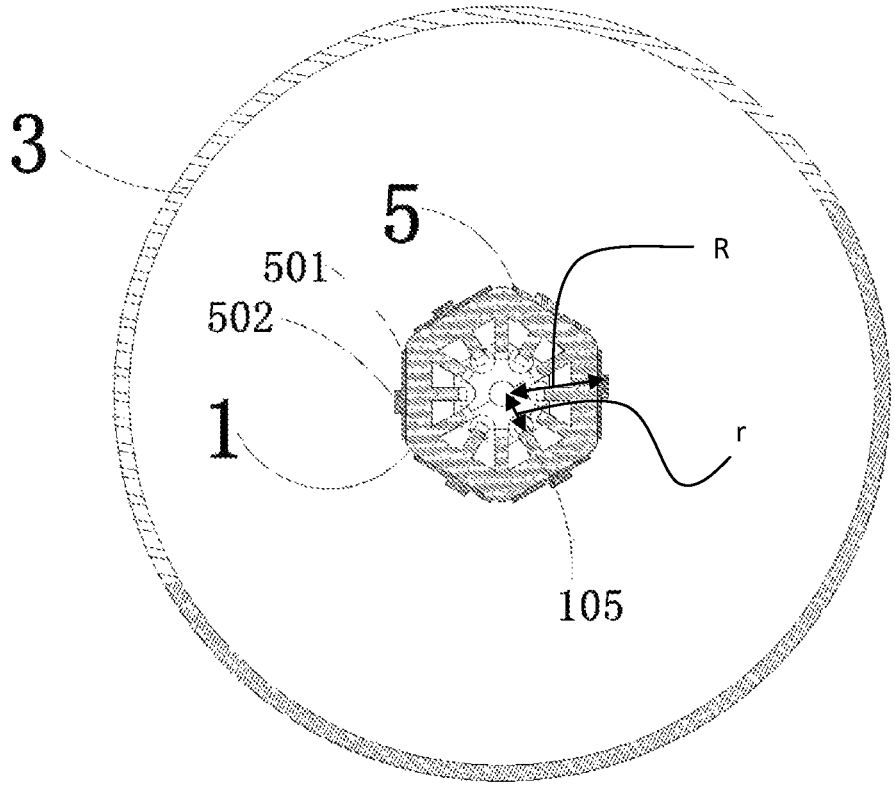
FIG. 8 is a cross-sectional view of the LED light bulb along the plane A-A in FIG. 3.

Turing to FIG. 8, FIG. 8 shows a cross section along A-A of the LED light bulb in FIG. 3. A-A defines a cross section in the latitudinal direction of the light bulb that includes the longest diameter. The heatsink 1 is disposed inside the outer case 3. The LED light module 5 is thermally coupled to the exterior surface of the upper portion 103 of the heatsink 1. The exterior surface of the upper portion 103 of the heatsink 1 is configured to have a longitudinal length that minimizes the problem that the upper portion 103 of the heatsink 1 protrudes into the luminous field generated by the LED light source 502. The exterior surface of the upper portion 103 of the heatsink 1 and the interior surface of the outer case 3 are configured to have a space between them to prevent bright points of the LED light source from being seen by human eyes. Preferably, the space is in the range of 5 to 30 millimeters, and most preferably, 18 to 22 millimeters.

The surface of the LED light module 5 is covered by a dielectric layer as protective insulator, which, however, compromises heat dissipation. In accordance with an exemplary embodiment of the claimed invention, a layer of graphene is coated on the surface of the LED light module 5 and the surface of the heatsink 1. The graphene layer is not only highly optically transmissive and but also enables quick conduction of heat from the surface of the LED light module 5 to the surface of the heatsink 1. Graphene is an allotrope of carbon in the form of a two-dimensional, atomic-scale and hexagonal lattice. It is stronger than steel by weight, conducts heat efficiently (thermal conductivity is 5300 $W \cdot m^{-1} \cdot K^{-1}$) and is nearly transparent (absorbs 2.6% of green light and 2.3% of red light). Thus, graphene is an ideal material for purposes of heat dissipation with LED luminaries.

Generally, an LED light bulb is expected to emit at least 800 lumens. In accordance with an exemplary embodiment of the claimed invention, the LED light source 502 on the LED light module 5 comprises an array of low-power LED packages (28×35). Each of the LED packages is kept apart by a distance in the range of 5 to 10 millimeters to facilitate heat dissipation and to prevent bright points from being seen by human eyes. In another embodiment, the LED light source 502 on the LED light module 5 comprises two mid-power LED packages (1 W; 28×35), which are spaced apart by 10 millimeters or more. In yet another embodiment, six LED light modules 5 configured in either of the aforementioned manners are thermally coupled to respective exterior surfaces of the upper portion 103 of the heatsink 1. The six LED light modules 5 are evenly arranged around a circle and form an angle of 15 degrees in relation to the perpendicular axis. Theoretically, the LED light bulb in this embodiment should emit more than 1000 lumens. Compromised by thermal resistance and light absorption of various parts of the bulb, the actual output generally exceeds 800 lumens.

Figure 9:
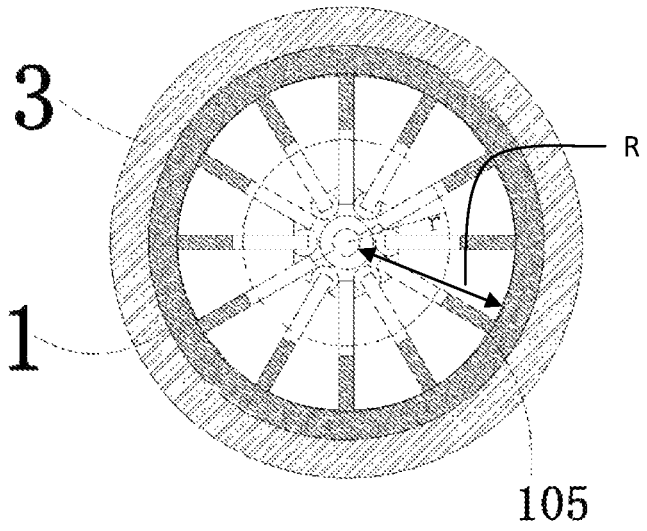
FIG. 9 is a cross-sectional view of the LED light bulb along the plane B-B in FIG. 3.

Turning to FIG. 9, FIG. 9 shows a cross section along B-B of the LED light bulb in FIG. 3. B-B defines a cross section in the latitudinal direction of the lower portion of the heatsink 1. A plurality of fins 105 are disposed inside the heatsink 1. The fins 105, which maximize the overall surface of the heatsink 1 in contact with airflow, facilitate removal of heat through radiation and convection. In one embodiment, the plurality of fins 105 include a number of fins in the range of 2 to 50. Preferably, the plurality of fins 105 include a number of fins in the range of 3 to 30, or most preferably, 6 to 20.

Figure 14:
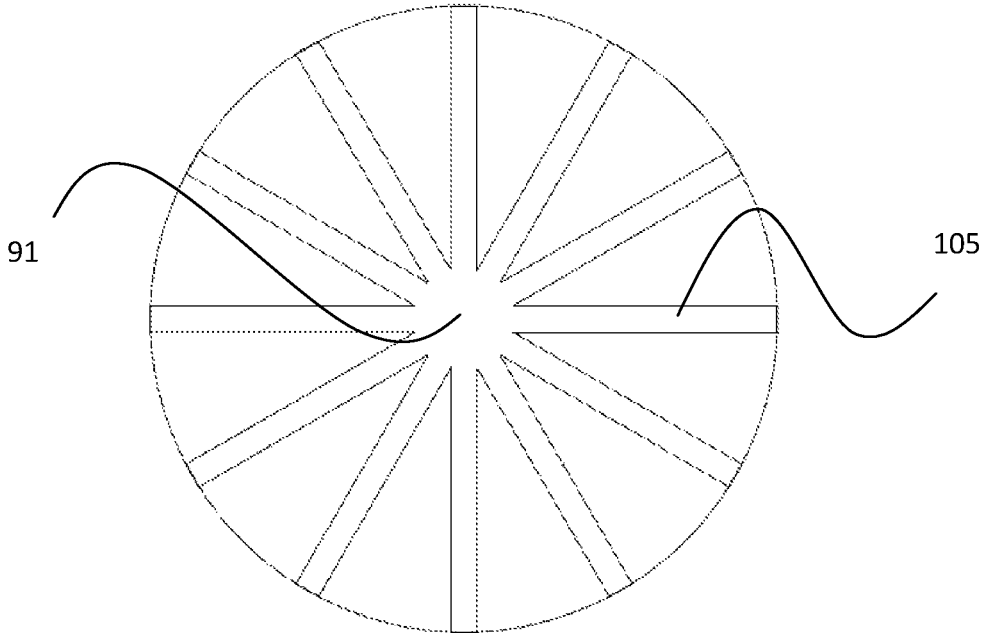
FIG. 14 is a schematic diagram of the heatsink of an LED light bulb in accordance with an exemplary embodiment of the claimed invention where the distance from the tip of the fin to the central axis of the heatsink is zero.
Figure 15:
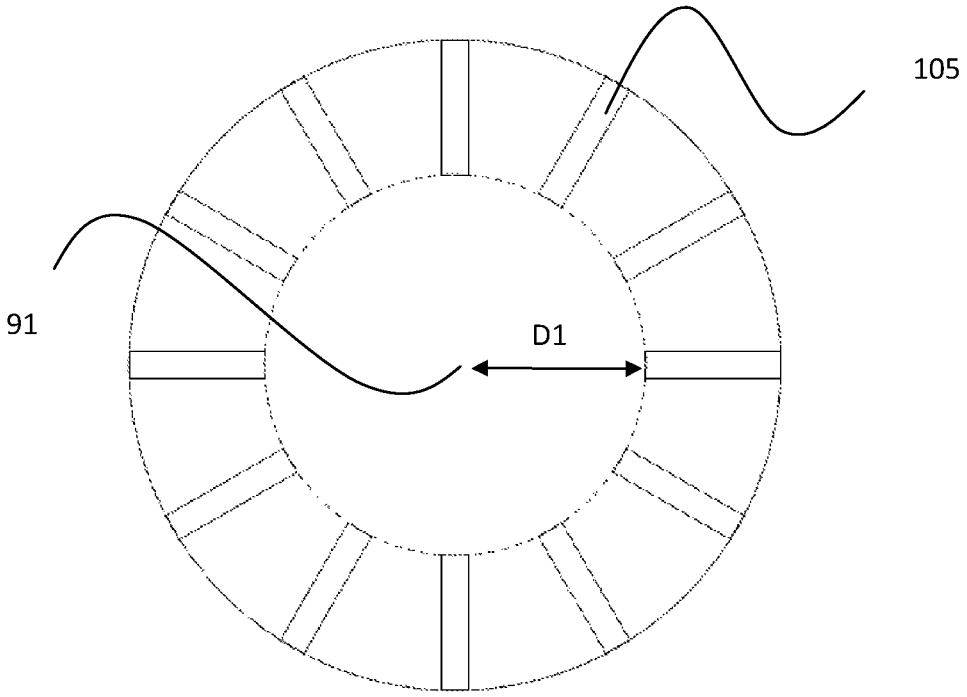
FIG. 15 is a schematic diagram of the cross section of a LED light bulb along the plane B-B in FIG. 3 in accordance with an exemplary embodiment of the claimed invention where the respective distances from the tips of each of the fins to the central axis of the heatsink are equal.

Returning to FIGS. 3 and 4, in accordance with an exemplary embodiment of the claimed invention, the LED light bulb comprises an outer case 3, a heatsink 1, an LED light module 5, a power driver 2 and a metallic bulb base 4. The LED light module 5 includes a circuit board 501 and an LED light source 502. The outer case 3 includes a plurality of vent apertures. A plurality of fins 105 extend from the interior surface of the heatsink 1 inwardly towards the central axis of the heatsink 1. The interior surface of the heatsink 1 and an exterior surface of the fins 105 define a heatsinking pathway. The heatsinking pathway and the vent apertures are disposed and configured to provide a convective airflow pathway. A central axis XX is defined inside the heatsink 1. The central axis XX intersects the plane to which the central axis is a normal line at an intersection point 91 inside the heatsinking pathway. In one embodiment, as shown in FIG. 14, the distance along the plane B-B from the tip of each of the plurality of fins 105 to at least one point on the central axis XX is zero.

As show in FIGS. 15 to 18, in another embodiment, the distance along the plane B-B from the tip of the fin 105 to the central axis XX is greater than zero. Focusing on FIG. 15, a hypothetical circle (dotted line) is defined by the set of all points on the plane B-B at the distance D1 from the intersection point 91. When the heatsink 1 includes exactly one fin 105, the tip of the fin 105 falls right on the perimeter of the hypothetical circle. When the heatsink 1 includes a plurality of fins 105, each of the respective distances along the plane B-B from the tips of the plurality of fins 105 to the central axis XX is D1. Consequently, each of the tips of the plurality of fins 105 falls on the perimeter of the hypothetical circle.

Figure 16:
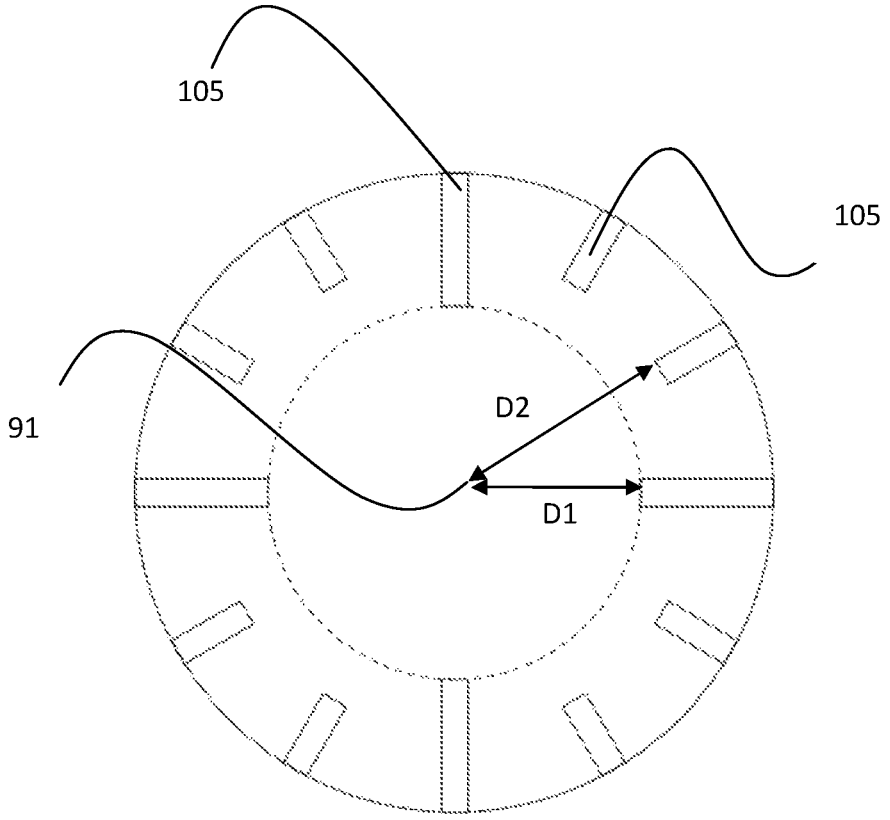
FIG. 16 is a schematic diagram of the cross section of a LED light bulb along the plane B-B in FIG. 3 in accordance with an exemplary embodiment of the claimed invention where the distance from the tip of a first fin to the central axis of the heatsink is different from that of a second fin.

In yet another embodiment, as shown in FIG. 16, a hypothetical circle (dotted line) is defined by the set of all points on the plane B-B at the distance D1 from the intersection point 91. The heatsink 1 includes a plurality of fins 105. The distance along the plane B-B from the tip of a first fin to the central axis XX is D1. The distance from the tip of a second fin is to the central axis XX is D2. D2 is greater than D1. Consequently, the tip of the first fin 105 falls on the perimeter of the hypothetical circle but that of the second fin does not.

Figure 17:
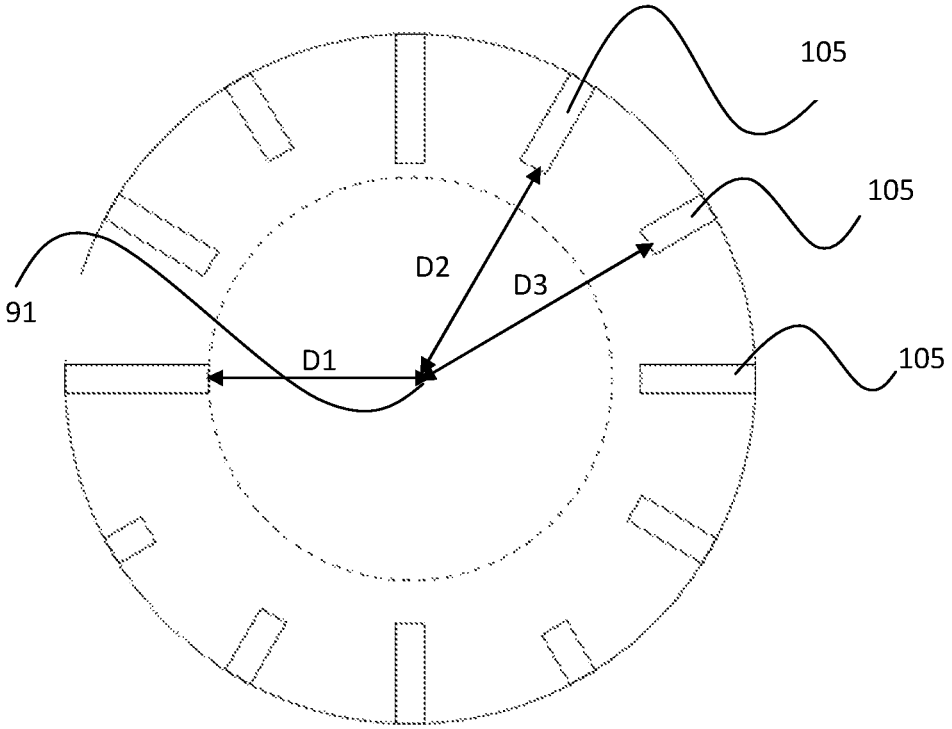
FIG. 17 is a schematic diagram of the cross section of a LED light bulb along the plane B-B in FIG. 3 in accordance with an exemplary embodiment of the claimed invention where the respective distances from the tips of a first fin, a second and a third fin to the central axis of the heatsink are different from one another.

Turning to FIG. 17, in yet another embodiment, a hypothetical circle (dotted line) is defined by the set of all points on the plane B-B at the distance D1 from the intersection point 91. The heatsink includes a plurality of n fins 105 (only three fins are shown). The distances along the plane B-B from the tips of a first fin, a second fin, a third fin, . . . and an Nth fin to the central axis XX are, respectively, D1, D2, D3, . . . and Dn, where D1<D2<D3< . . . <Dn. Consequently, only the tip of the first fin 105 falls on the perimeter of the hypothetical circle but the tips of all other fins 105 the distances from which to the central axis XX are greater than D1 do not.

Figure 18:
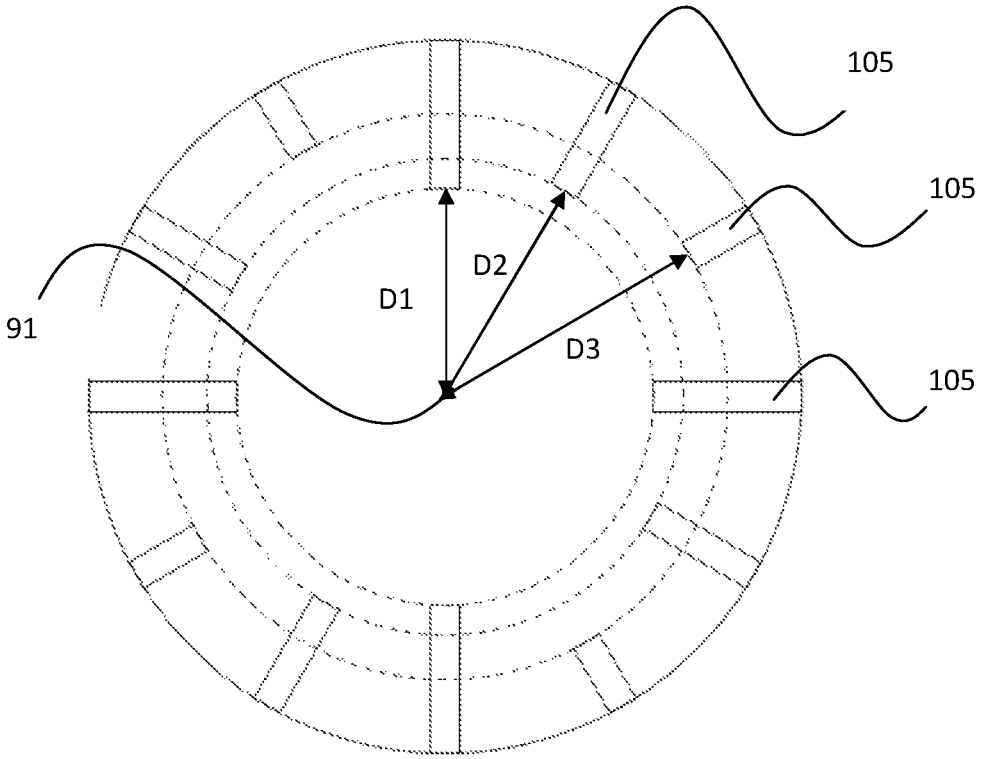
FIG. 18 shows the hypothetical circles where the tips of the fins of the LED light bulb in FIG. 17 fall on the perimeters of the respective circles.

Turning to FIG. 18, in yet another embodiment, three hypothetical circles (dotted lines) are defined by respective sets of all points on the plane B-B at the distances D1, D2 and D3 from the intersection point 91, where D1<D2<D3. The heatsink includes a plurality of fins 105. The distances along the plane B-B from the tip of a first fin, a second fin and a third fin to the central axis XX are, respectively, D1, D2 and D3. Consequently, the hypothetical circle passes through only a portion of the fins 105, either at the tip of a fin or at a point on a fin between the tip and the base, but does not intersect all other fins 105. In particular, only the tip of the first fin 105 falls on the perimeter of the hypothetical circle with the diameter D1 while those of all other fins 105 the distances from which to the central axis XX are greater than D1 do not. Nor does the hypothetical circle with the diameter D1 cross the second fin or the third fin. Additionally, only the tip of the second fin 105 falls on the perimeter of the hypothetical circle with the diameter D2 while those of all other fins 105 the distances from which to the central axis XX are greater or less than D2 do not. The hypothetical circle with the diameter D2 crosses the first fin 105 but not the third fin 105. Finally, only the tip of the third fin 105 falls on the perimeter of the hypothetical circle with the diameter D3 while those of all other fins 105 the distances from which to the central axis XX are less than D3 do not. The hypothetical circle with the diameter D3 crosses both the first fin 105 and the second fin 105.

Returning to FIGS. 4 and 6, in accordance with an exemplary embodiment of the claimed invention, the heatsink 1 includes an exterior surface substantially in the shape of a hollow cylinder. The heatsink 1 has a length-to-width ratio greater than 2.5. Preferably, the ratio is in the range of 2.5 to 10. For light bulbs commonly found on the shelf, e.g. A19, A20 and A67, the longitudinal length H of the heatsink 1 is in the range of 40 to 80 millimeters. The heatsinking pathway is configured to include a lower portion having a bigger caliber than the upper portion. The structure facilitates the stack effect and, therefore, helps propel airflow upwards inside the heatsink 1. The upper end of the heatsink 1 is coupled to the top exhaust channel 7. Thermally loaded air coming to the uppermost end of the heatsink 1 goes on to travel through the top exhaust channel 7 and then egresses the light bulb through the top vent apertures 304 under the dome of the outer case.

Turning to FIGS. 8 and 9, FIGS. 8 and 9 show the cross sections of the heatsink 1 as shown in FIG. 3, defined, respectively, by the plane A-A and the plane B-B. Although a set of twelve fins are depicted in the figures, the number is meant to be illustrative and not in any way limiting. In accordance with an exemplary embodiment of the claimed invention, the lower portion of the interior surface of the heatsink 1 has a radius (R) in the range of 10 to 15 millimeters. In other words, the distance from the central axis XX to the interior surface of the heatsink 1 is in the range of 10 to 15 millimeters. As shown in FIGS. 14 to 18, the radius (r) of the hypothetical circle encompassing all of the tips of the fins, i.e. the distance from the central axis to each of the tips of the fins, is equal to or greater than 0 but less than 15 millimeters. When the heatsink 1 has an internal radius (R) of 15 millimeters and r is zero, all the tips of the fins 105 reach to the central axis. When the heatsink 1 has an internal radius (R) of 15 millimeters and r is 15 millimeters, the heatsinking pathway is devoid of any fins 105. Preferably, r is greater than 0 for purposes of easy unmolding while making the heatsink 1. Most preferably, r is in the range of 2 to 12 millimeters. The radial depths of the fins 105 and the axial length of the heatsink 1 jointly define a substantially cylindrical space inside the heatsink 1 for thermal energy to be transferred inside the space radiatively and convectively. In the embodiments as shown in FIGS. 3 to 9, the internal radii (R) of the heatsink 1 reduces incrementally from the bottom to the top. For example, the internal radii of the heatsink 1 start from 15 millimeters at the bottom but gradually reduce to 10 millimeters at the top. In one embodiment, the radii (r) of the hypothetical circles encompassing the tips of the fins 105, i.e. the distances from the central axis to the tips of the fins, do not have to be a constant. In other words, the respective depths of the fins 105 extending inwardly towards the central axis, i.e. R minus r, either remain constant regardless of their longitudinal positions in relation to the heatsink 1, or alternatively, vary depending on their longitudinal positions in relation to the heatsink 1. In the preferred embodiments as shown in FIGS. 8 and 9, the respective radii (r) of the hypothetical circles, i.e. the respective distances from the central axis to the tips of the fins, reduce correspondingly as the internal radii (R) of the heatsink 1 reduce gradually when their longitudinal positions go upwards from the plane B-B where R and r are largest to the plane A-A where R and r are smallest. The respective base lengths of the fins 105 on the interior surface of the heatsink 1 either remain constant, or alternatively, vary depending on their positions in relation to the interior surface of the heatsink 1. The base of a fin 105 on the interior surface of the heatsink 1 extends either linearly in a direction parallel to the central axis of the heatsink 1, or alternatively, along a helical path to form a spiral structure around the central axis of the heatsink 1.

Figure 1:
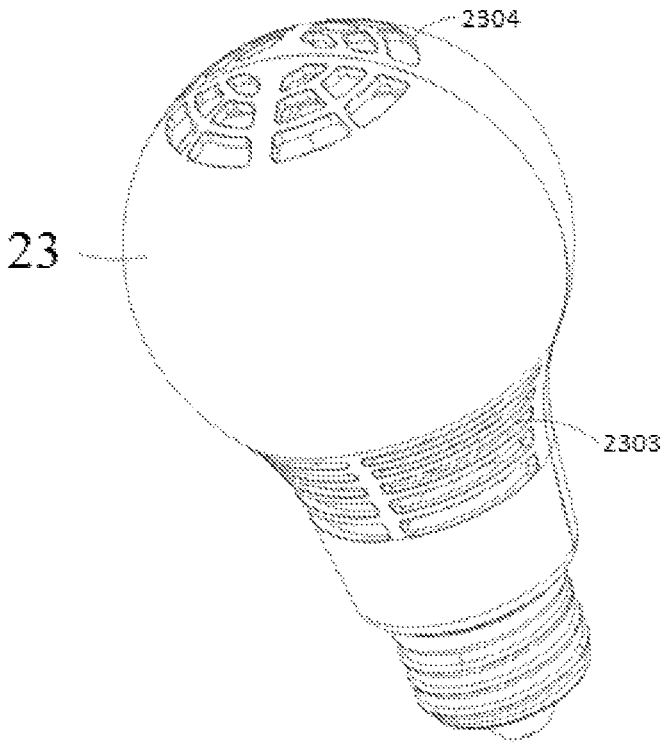
Fig.1 (Prior Art)
FIG. 1 is a perspective view of an LED light bulb disclosed in the prior art.
Figure 2:
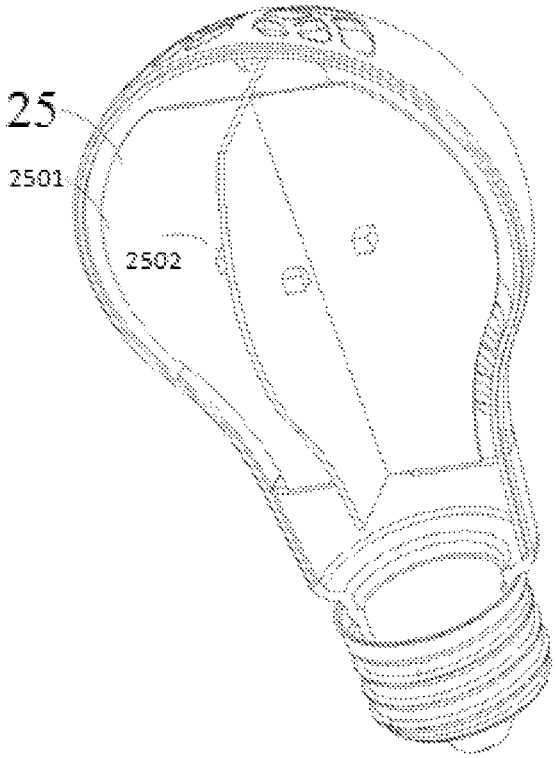
Fig.2 (Prior Art)
FIG. 2 is a perspective view of the LED light bulb in FIG. 1 illustrating the internal structure thereof.

Some attempted solutions provide an LED light bulb, as shown in FIGS. 1 and 2. They have not sufficiently addressed the needs of the industry owing to potential loss of luminous output, higher cost and risk of electric shock. The LED light bulb comprises an outer case 23 and two LED circuit boards 2501. The outer case 23 is made of plastic insulating material and includes a plurality of upper vent apertures 2304 on the upper portion of the outer case 23 and a plurality of lower vent apertures 2303 on the lower portion of the outer case 23. The two larger-than-usual LED circuit boards 2501, having an area of approximately 1150 square millimeters, are disposed inside the outer case 23 and intersect each other at right angles. Heat generated by LED packages is conducted to the circuit boards 2501 and then taken away through a convection pathway defined by the outer case 23 and the pair of LED circuit boards 2501. The LED packages—mounted on the LED circuit boards, which are disposed vertically inside the outer case 23—are thus configured to direct their luminous outputs across a wider angle.

The role otherwise played by a metallic heatsink in some light bulbs now has to be accommodated by LED the circuit boards 2501, which do not always do a good job. To cope with overheating issues, enlarged LED circuit boards 2501 must be provided, which drive cost up. When an oversized LED circuit board 2501 gets very close to or even in contact with the inner surface of the outer case 23, light beaming from the LED packages are not well diffused—thus discrete dim spots are seen—to visually resemble incandescent lamps. Moreover, we don't obtain as much luminous output as we should because a significant amount of light is shed onto the LED circuit boards 2501 but only a fraction of that light will then be reflected by the LED circuit boards 251 to the inner surface of the outer case 23—as opposed to light beaming directly, and more efficiently, to the outer case 23.

Furthermore, when almost the entire space inside the outer case 23 constitutes the convection pathway, the convection activity inside the light bulb is not as effective as when a more structurally defined pathway is provided. Finally, larger vent apertures must be provided to make up for an absence of a metallic heatsink and weak thermal conductivity of the LED circuit boards 2501. In one embodiment, the upper apertures 2304 are 634 square millimeters and the lower apertures 2303 are 1500 square millimeters. The apertures 2304, 2304—with a sizable opening of 2134 square millimeters combined—heighten the threat of electric shock because electricity-loaded parts inside the light bulb are inadvertently accessible.

Having described at least one of the embodiments of the claimed invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. An LED light bulb, comprising:
a metallic bulb base;
an outer case fixed to the metallic bulb base;
a heatsink having an interior surface, a circular exterior surface and a plurality of planar exterior surfaces;
a plurality of LED light modules thermally coupled to the plurality of planar exterior surfaces;
a power driver installed in the metallic bulb base;
a wire electrically connecting the power driver and LED light modules; and
wherein:
the heatsink is disposed inside the outer case and is mounted on the upper end of the metallic bulb base;
the interior surface defines a heatsinking pathway;
an upper portion of the heatsink comprises the plurality of planar exterior surfaces defining a pyramidal frustum;
a lower portion of the heatsink comprises the circular surface in a shape of a cylinder;
a wall of the upper portion of the heatsink is thicker than a wall of the lower portion of the heatsink;
the wire extends along the heatsinking pathway and through an opening at a topmost end of the heatsink;
the outer case comprises a plurality of vent apertures;
an upper portion of the outer case is transparent and a lower portion of the outer case is diffusive;
a plurality of fins extends from the interior surface of the heatsink inwardly towards a central axis of the heatsink; and
the heatsinking pathway and the vent apertures are disposed and configured to provide a convection airflow pathway.

2. The LED light bulb in claim 1, wherein the vent apertures include an upper aperture and a lower aperture; and ambient air enters through the lower aperture, then travels along the heatsinking pathway and egresses through the upper aperture.

3. The LED light bulb in claim 1, wherein the outer case includes a top exhaust channel; and the top exhaust channel is disposed within the outer case and extends inwardly from a dome of the outer case.

4. The LED light bulb in claim 2, wherein the outer case includes a top exhaust channel; and the top exhaust channel is disposed within the outer case and extends inwardly from a dome of the outer case.

5. An LED light bulb, comprising:
a metallic bulb base;
an outer case fixed to the metallic bulb base;
a heatsink having an interior surface, a circular exterior surface and a plurality of planar exterior surfaces;
a plurality of LED light modules thermally coupled to the plurality of planar exterior surfaces;
a power driver installed in the metallic bulb base;
a wire electrically connecting the power driver and the LED light modules; and
wherein:
the heatsink is disposed inside the outer case and is mounted on the metallic bulb base;
the interior surface defines a heatsinking pathway;
an upper portion of the heatsink comprises the plurality of planar exterior surfaces defining a pyramidal frustum;
a lower portion of heatsink comprises the circular exterior surface in a shape of a cylinder;
the heatsink is made of metal and a layer of aluminum oxide is coated on the interior surface of the heatsink;
a wall of the upper portion of the heatsink is thicker than a wall of the lower portion of the heatsink;
the lower portion of the heatsinking pathway has a bigger caliber than the upper portion of the heatsinking pathway;
a layer of graphene is coated on the surface of the plurality of LED light modules;
the wire extends along the heatsinking pathway and through an opening at a topmost end of the heatsink;
the outer case comprises a plurality of vent apertures, the upper portion of the outer case is transparent and the lower portion of the outer case is diffusive;
the outer case includes a pair of half pieces which are symmetrical with respect to a longitudinal axis;
a plurality of fins extends from an interior surface of the heatsink inwardly towards a central axis of the heatsink; and the heatsinking pathway and the vent apertures are disposed and configured to provide a convection airflow pathway.

6. The LED light bulb in claim 4, wherein the lower aperture, the heatsinking pathway, the top exhaust channel and the upper aperture are disposed and configured to provide a convection airflow pathway.

7. The LED light bulb in claim 6, wherein the outer case includes a pair of half pieces which are symmetrical with respect to a longitudinal axis; and the outer case is formed by joining the pair of half pieces together.

8. The LED light bulb in claim 7, wherein:

the heat sink comprises a plurality of fins;

the heatsink defines a central axis passing therethrough;

the heatsink further defines an intersection point at which the central axis intersects a plane to which the central axis is a normal line; and a distance from the central axis of the heatsink to a tip of the each of the plurality of fins is greater than zero.

9. The LED light bulb in claim 8, wherein the tip of each of the plurality of fins is on a far side from the interior surface of the heatsink; and the distances along the plane from the intersection point to each of the tips of the plurality of fins are same.

10. The LED light bulb in claim 8, wherein the tip of each fin of the plurality of fins is on a far side from the interior surface of the heatsink; and the distances along the plane from the intersection point to the tips of at least two of the plurality of the fins are different.

11. The LED light bulb in claim 7, further comprising a layer of graphene coated on a surface of the plurality of LED light modules.

12. The LED light bulb in claim 7, further comprising a layer of graphene coated on the plurality of planar exterior surfaces of the heatsink.

13. The LED light bulb in claim 12, wherein a lower portion of the heatsinking pathway has a bigger caliber than an upper portion of the heatsinking pathway.

* * * * *